United States Patent [19]

Hollingsworth et al.

[11] 4,141,275

[45] Feb. 27, 1979

[54] AFTERBURNER RECOILLESS RIFLE

[75] Inventors: Guilford L. Hollingsworth, China Lake; Alexander C. Charters, Santa Barbara, both of Calif.

[73] Assignee: The United States of America as represented by the Secretary of the Navy, Washington, D.C.

[21] Appl. No.: 815,736

[22] Filed: Jul. 14, 1977

[51] Int. Cl.[2] ..... F41F 3/02

[52] U.S. Cl. ..... 89/1.703

[58] Field of Search ..... 89/1.703, 1.704, 1.705, 89/1.7

[56] References Cited

U.S. PATENT DOCUMENTS

| | | | |
|---|---|---|---|
| 2,489,748 | 11/1949 | Burney | 89/1.703 |
| 2,965,000 | 12/1960 | Skinner | 89/1.7 |
| 3,008,378 | 11/1961 | Musser | 89/1.703 |
| 3,446,111 | 5/1969 | Dardick | 89/1.7 |
| 3,738,219 | 6/1973 | Febres | 89/1.703 |
| 3,745,876 | 7/1973 | Roca | 89/1.7 |
| 3,827,332 | 8/1974 | Lindsay | 89/1.7 |
| 3,838,622 | 10/1974 | Febres | 89/1.703 |

FOREIGN PATENT DOCUMENTS

| | | | |
|---|---|---|---|
| 943263 | 10/1948 | France | 89/1.703 |
| 1124434 | 7/1956 | France | 89/1.703 |
| 468583 | 7/1937 | United Kingdom | 89/1.703 |
| 586749 | 3/1947 | United Kingdom | 89/1.703 |

*Primary Examiner*—David H. Brown

*Attorney, Agent, or Firm*—R. S. Sciascia; W. Thom Skeer

[57] ABSTRACT

Rearwardly exhausted powder gases from a recoilless rifle are combined with air and combusted in an afterburner that is attached to the rifle. Thrust produced by the combustion is utilized to assist in counter-recoil.

2 Claims, 1 Drawing Figure

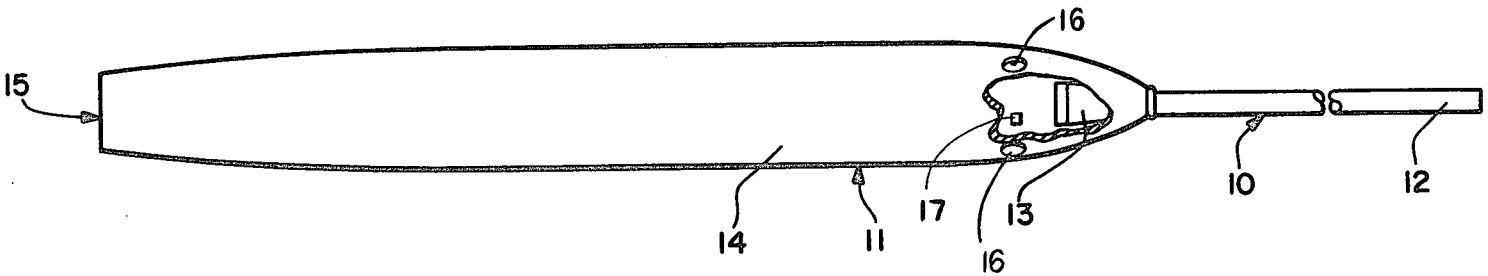
15
14
11
17
16
13
16
10
12

AFTERBURNER RECOILLESS RIFLE

BACKGROUND OF THE INVENTION

1. Field of the Invention

This invention relates to methods and aparatus for (1) increasing the efficiency of a recoilless rifle and (2) making it feasible to mount a recoilless rifle on and fire a recoilless rifle from an aircraft.

2. Description of the Prior Art

A recoilless rifle balances recoil, i.e., provides counter-recoil action, by exhausting a portion of the powder gas rearwardly. To achieve a given muzzle velocity for a projectile of a given mass, a recoilless rifle requires a substantially larger amount of powder than does a conventional closed-breech gun. This is because that portion of the powder gas which is exhausted rearwardly is not available to drive the forward moving projectile from the barrel. It would be advantageous if less gas could be used to provide counter-recoil action. This would provide for either of two attractive alternatives. If one used the same amount of powder that is ordinarily used, one could make the jets in the breech (through which counter-recoil gas flows) smaller and, because more gas would be available to drive the projectile, this would cause greater muzzle velocity. On the other hand, one could utilize a smaller powder charge to achieve the same muzzle velocity as is presently achieved (again because the breech jets could be made smaller and a greater portion of the powder gas would be available to drive the projectile).

When a recoilless rifle is fired, the rearwardly directed counter-recoil gases produce what is known as the breech blast. Because of this breech blast, a recoilless rifle may not be mounted just anywhere on an aircraft. For example, if a recoilless rifle were mounted on the center-line of an aircraft, the breech blasts would expend against the fuselage and rupture it. A good description of this particular problem appears in U.S. Pat. No. 3,827,332 which issued to David B. Lindsay, Jr. on Aug. 6, 1974. Lindsay solves the problem by mounting the recoiless rifle on the tip of the aircraft wing so that the breech blast will be spaced far enough away from any part of the aircraft that it will be unable to do any damage. In certain situations, however, it would be advantageous to be able to mount a recoilless rifle on the center-line of an aircraft or at least in positions other than on the extreme wing tip.

SUMMARY OF THE INVENTION

According to the present invention both of the aforementioned advantages, i.e., the alternative of achieving greater muzzle velocity with a given amount of powder or the same muzzle velocity with less powder and the alternative of mounting a recoilless rifle on an aircraft in a position other than at the extreme tip of the wing, are achieved by providing the recoilless rifle with an afterburner. Counter-recoil gas is burned in the afterburner and exhausted through an afterburner nozzle to provide additional counter-recoil. This additional counter-recoil permits the use of less counter-recoil gas and thus provides for the first advantage mentioned. The afterburner itself absorbs the shock of the breech blast and thus protects the aircraft from it and provides for the second advantage mentioned.

BRIEF DESCRIPTION OF THE DRAWING

The single FIGURE of the drawing is a partially cut away elevational view of a recoilless rifle with an afterburner attached according to this invention.

DESCRIPTION OF THE PREFERRED EMOBODIMENT

The mechanical aspects of this invention may be readily understood by referring to the drawing. The drawing depicts a recoilless rifle 10 with an afterburner 11 attached. The recoilless rifle has a barrel 12 and a breech 13. The forward end of the afterburner is attached at the juncture of these two parts. The afterburner, of course, has a combustion chamber 14 and terminates at its aft end with a nozzle 15. The attachment of the afterburner to the rifle may be readily accomplished by any of several known means (such as by welding, bolting, screwing or by simply providing a close fitting foward end opening big enough for the rifle barrel to pass through but not big enough for the rifle breech to pass through) and will provide no trouble to those skilled in the mechanical arts. The attachment should be relatively air tight. The numeral 16 indicates an air inlet through which air may enter the chamber and the numeral 17 indicates a standard ignition device. Air scoops or the like may, of course be connected to the air inlet to assist in directing air toward it.

The afterburner may be similar to a conventional ramjet or pulse jet engine with air inlets to allow chamber 14 to fill with air and ignition means to ignite the mixture of air and powder gas that forms in chamber 14 when the rifle is fired. Means for taking air into pulsejets and ramjets and means for igniting propellants in such engines are discussed by Ahnstrom in "The Complete Book of Jets and Rockets," The World Publishing Co., Cleveland and New York (1957).

When the rifle is fired, the following sequence of events takes place. First, powder gas starts expanding. A portion of the gas moves forward driving the projectile out of the forward end of the barrel. Another portion of the gas exhausts rearwardly from the breech through jets into chamber 14. This latter portion is the counter-recoil gas. Next, the counter-recoil gas mixes with air in chamber 14. This mixing occurs rapidly and is completed as the last of the powder gas exhausts into the afterburner. Next, the mixture of air and counter-recoil gas in the chamber is ignited. Ignition occurs before or shortly after the projectile has exited from the barrel. Finally, the gases produced by ignition of the mixture of air and counter-recoil gas are exhausted through nozzle 15. This latter event produces jet impulse which is used to produce a portion of the counter-recoil action on the rifle. The bulk of the jet impulse presses against the rifle breech providing counter-recoil action. To utilize 100% of this force to provide counter-recoil action, the air inlets of the afterburner may be provided with closure flaps or the like which close when pressure builds in the combustion chamber. This will prevent force produced by jet impulse from being expended through the air inlets and wasted.

The recoilless rifle and afterburner may not be motionless during the firing. Rifle and afterburner may move a short distance during combustion and exhaustion of gases in chamber and afterburner. However, at the end of the firing there is no residual motion. The rifle may have been displaced a short distance during the firing but the velocity at the end is zero. The absence of residual motion is the meaning of "recoilless."

Nitrocellulose compounds are commonly used as the propellant in recoilless rifles. A significant fraction of the gas produced by nitrocellulose propellants is carbon monoxide (i.e.: half in some propellants). A mixture of carbon monoxide and oxygen (from the air in chamber 14) readily burns producing carbon dioxide. It has been found that if a 106 mm. recoilless rifle utilizing a conventional nitrocellulose powder load is fired so that the counter-recoil gas exhausts into a combustion chamber, mixes with enough air to provide a stoichiometric amount of oxygen, is burned and is exhausted through a nozzle as described above, the size of the counter-recoil jets can be reduced to less than half of the size required when no afterburning takes place. This has the effect of doubling the muzzle velocity of the projectile. The ratio of impulse provided by afterburning to projectile momentum, if a stoichiometric amount of oxygen is provided is actually 1 to 2.34. That is, the total amount of counter-recoil gas can be reduced by 1/2.34.

On the other hand, less than a conventional amount of powder may be used. If a smaller powder load is utilized, the muzzle velocity will not be doubled but the combustion chamber of the afterburner may be made smaller than is the case where a conventional amount of powder is used. In order to provide for a stoichiometric amount of oxygen where the air is under 1 atmosphere of pressure and a conventional amount of powder is used in a 106 mm. recoilless rifle, the afterburner volume must be 84.9 cubic feet. If less powder were used, this volume could naturally be decreased.

Still another alternative exists. One may simply not decrease the counter-recoil jet area by so much, i.e., less than by 1/2.34, and can provide for less than a stoichiometric amount of oxygen. That is, it is not necessary to burn all of the carbon monoxide in the counter-recoil gas. If less than all of the carbon monoxide is burned, the jet impulse produced will be smaller but the advantages of achieving either a greater muzzle velocity from a given amount of powder or of being able to use less powder will still be achieved.

The advantage of being able to mount the rifle anywhere on an aircraft rather than on the aircraft wing tip is important too. To achieve this advantage, the afterburner need not even be an afterburner. That is, the advantage flows naturally from the fact that what has heretofore been called an afterburner is also a shield. The "afterburner" protects any adjacent portions of the aircraft from the breech blast of the rifle.

What is claimed is:

1. A combination of apparatus comprising:

a. a recoilless rifle having a barrel and a breech and b. an afterburner having a forward end, a combustion chamber and an after end, said forward end being affixed to said rifle at the juncture of said barrel and breech, said afterburner being provided with air inlets to allow said combustion chamber to fill with air and with ignition means and said aft end being a nozzle.

2. In a method for firing a recoilless rifle wherein rearwardly directed gas from the recoilless rifle is utilized to produce counter recoil action, the improvement residing in:

a. affixing an afterburner having an open forward end, a combustion chamber with air inlets to allow air to enter and an aft end to said recoilless rifle in a position such that the barrel of said recoilless rifle passes through said open forward end and the breech of said recoilless rifle is behind said open forward end;

b. allowing oxygen containing air to enter said combustion chamber through said air intets;

c. allowing said rearwardly directed gas to mix with said air in said combustion chamber;

d. igniting the mixture of air and rearwardly directed gas; and e. exhausting the products produced by said ignition through said aft end of said afterburner.

* * * * *